US009162744B2

(12) United States Patent
Hitachi et al.

(10) Patent No.: US 9,162,744 B2
(45) Date of Patent: Oct. 20, 2015

(54) SHIP MANEUVERING DEVICE

(75) Inventors: Junichi Hitachi, Osaka (JP); Naohiro Hara, Osaka (JP); Takao Nakanishi, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 16 days.

(21) Appl. No.: 14/129,833

(22) PCT Filed: Mar. 29, 2012

(86) PCT No.: PCT/JP2012/058428

§ 371 (c)(1),
(2), (4) Date: Feb. 4, 2014

(87) PCT Pub. No.: WO2013/001874

PCT Pub. Date: Jan. 3, 2013

(65) Prior Publication Data

US 2014/0179177 A1 Jun. 26, 2014

(30) Foreign Application Priority Data

Jun. 28, 2011 (JP) ..... 2011-143443

(51) Int. Cl.
*B63H 21/21* (2006.01)
*B63H 25/42* (2006.01)

(52) U.S. Cl.
CPC ..... *B63H 21/213* (2013.01); *B63H 25/42* (2013.01)

(58) Field of Classification Search
CPC ..... B63H 21/21; B63H 21/213; B63H 25/42
USPC ..... 440/1, 2, 84, 86, 87
See application file for complete search history.

(56) References Cited

U.S. PATENT DOCUMENTS

| | | | | |
|---|---|---|---|---|
| 8,038,489 | B2 * | 10/2011 | Suzuki et al. | 440/1 |
| 2005/0164569 | A1 | 7/2005 | Kaji et al. | |
| 2007/0017426 | A1 * | 1/2007 | Kaji et al. | 114/144 RE |
| 2009/0215331 | A1 * | 8/2009 | Suzuki et al. | 440/1 |
| 2009/0215337 | A1 * | 8/2009 | Suzuki et al. | 440/86 |
| 2009/0221194 | A1 | 9/2009 | Suzuki et al. | |

FOREIGN PATENT DOCUMENTS

| | | | |
|---|---|---|---|
| JP | H01-285486 | A | 11/1989 |
| JP | 2005-145439 | A | 6/2005 |
| JP | 2009-202778 | A | 9/2009 |

* cited by examiner

*Primary Examiner* — Lars A Olson
(74) *Attorney, Agent, or Firm* — Sterne, Kessler, Goldstein & Fox P.L.L.C.

(57) ABSTRACT

A ship maneuvering device rotates a propeller at a lower rotational frequency than the rotational frequency of the minimum idling speed of an engine. A control device has a crawling speed navigation mode. A crawling speed navigation mode button that selects whether or not to execute the crawling speed navigation mode is connected to the control device. When the crawling speed navigation mode is selected, and the amount of operation of a joystick lever is at or beneath a baseline amount of operation Ms, the control device causes the rotational frequency N of the engine to be the rotational frequency Nlow of the minimum idling speed, and in accordance with the amount of operation of the joystick lever, varies the duty ratio D, which is the fraction of time T1 that a main clutch is engaged in a predetermined cycle T, within a range of no greater than 100%.

5 Claims, 16 Drawing Sheets

(a)

(b)

SHIP MANEUVERING DEVICE

TECHNICAL FIELD

The present invention relates to a ship maneuvering device.

BACKGROUND ART

Conventionally, a ship is known having an engine, an outdrive device having a propeller rotated by power of the engine, and a clutch engaging and disengaging power transmission from the engine to the propeller (for example, see the Patent Literature 1). The ship described in the Patent Literature 1 is constructed so that the engine is rotated at a low idling rotation speed so as to rotate the propeller at a low speed, whereby sailing at a low speed (so-called troll sailing) is performed.

However, according to the art described in the Patent Literature 1, the troll sailing by slipping the clutch (so-called semi-clutch) cannot be performed. Namely, sailing with a sailing speed lower than the sailing speed at the low idling rotation speed of the engine cannot be performed, whereby the sailing speed may be too high so as to make the maneuvering of the ship difficult for some operators. For example, at the time of berthing and unberthing of the ship, the sailing speed may be too high so as to make the operation of the berthing and unberthing of the ship difficult for an unskilled operator unfamiliar to the maneuvering of the ship.

PRIOR ART REFERENCE

Patent Literature

Patent Literature 1: the Japanese Patent Laid Open Gazette Hei. 01-285486

DISCLOSURE OF INVENTION

Problems to be Solved by the Invention

In consideration of the above problems, the purpose of the present invention is to provide a ship maneuvering device which enables sailing with a sailing speed lower than the sailing speed at the low idling rotation speed of the engine so as to make the maneuvering of the ship easy.

The problems to be solved by the present invention have been described above, and subsequently, the means of solving the problems will be described below.

Means for Solving the Problems

According to the present invention, a ship maneuvering device has an engine, an outdrive device having a propeller rotated by power of the engine, a clutch engaging and disengaging power transmission from the engine to the propeller, an operation means actuating the outdrive device, and a control device connected to the engine, the clutch and the operation means. The control device has a very low speed sailing mode. The control device is connected to a determination means determining whether the very low speed sailing mode is executed or not. In the case in which execution of the very low speed sailing mode is determined, when an operation amount of the operation means is not more than a baseline operation amount, the control device makes a rotation speed of the engine be a low idling rotation speed and changes a duty ratio, which is a ratio of a time in which the clutch at a predetermined cycle has been turned on corresponding to the operation amount of the operation means, within a range not more than 100%.

According to the present invention, when the operation amount of the operation means excesses the baseline operation amount, the control device makes the duty ratio be 100% and increases the rotation speed of the engine from the low idling rotation speed corresponding to the operation amount of the operation means.

According to the present invention, when an increase amount of the operation amount of the operation means concerning the baseline operation amount is not higher than a baseline increase amount, the control device maintains the rotation speed of the engine at the low idling rotation speed.

According to the present invention, the control device is connected to a changing means changing the baseline operation amount.

Effect of the Invention

The present invention brings the following effects.

According to the present invention, by executing the very low speed sailing mode, the clutch is engaged and disengaged while the engine is rotated at the low idling rotation speed, whereby sailing at a speed lower than the sailing speed at the low idling rotation speed of the engine is enabled so as to make maneuvering of the ship easy. Since the sailing speed is changed by changing the duty ratio corresponding to the operation amount of the operation means, the sailing speed can be changed following a sailing situation so as to make the maneuvering of the ship easy.

According to the present invention, by operating the operation means, the engine rotation speed is increased from the low idling rotation speed, whereby the sailing speed can be increased following the sailing situation so as to make the maneuvering of the ship easy further.

According to the present invention, for the time being after the operation amount of the operation means excesses the baseline operation amount, the engine rotation speed is maintained at the low idling rotation speed, whereby the operator is not panicked by sudden change of the engine rotation speed and the maneuvering of the ship becomes easy further.

According to the present invention, by changing the baseline operation amount following the sailing situation, the maneuvering of the ship can be made easy further.

BRIEF DESCRIPTION OF DRAWINGS

FIG. 1 is a drawing of a maneuvering device according to the present invention.

FIG. 2 is a drawing of a ship and the maneuvering device.

FIG. 3 is a sectional left side view of an outdrive device.

FIG. 4 is a perspective view of a joystick lever.

FIG. 5 is a diagram of control flow of a maneuvering method of the ship.

FIG. 6(*b*) is a diagram of relation between the inclination amount of the joystick lever and the engine rotation speed at a very low speed sailing mode.

FIG. 7 is a diagram of control flow at the very low speed sailing mode.

FIG. 8 is a diagram of relation between the inclination amount of the joystick lever and a duty ratio and the engine rotation speed at the very low speed sailing mode.

FIG. 9 is a sectional right side view of the outdrive device.

FIG. 10 is a block drawing of a control device.

FIG. 11 is a flow chart of a calculation method of propulsion powers and directions of left and right outdrive devices.

FIG. 12(A) is a drawing of oblique sailing component propulsion power vectors of the outdrive devices. FIG. 12(B) is a drawing of turning component propulsion power vectors of the outdrive devices. FIG. 12(C) is a drawing of composition vectors of the outdrive devices.

FIG. 13 is a plan view of a rotation angle of the outdrive device.

FIG. 14 is a graph of relation of the angle of the composition vector and the rotation angle of the outdrive device.

FIG. 15 is a plan view of the rotation angle of the outdrive device.

FIG. 16 is a graph of relation of the rotation angle of the outdrive device and a reduction rate of an engine rotation speed.

DESCRIPTION OF NOTATIONS

Figure 1:
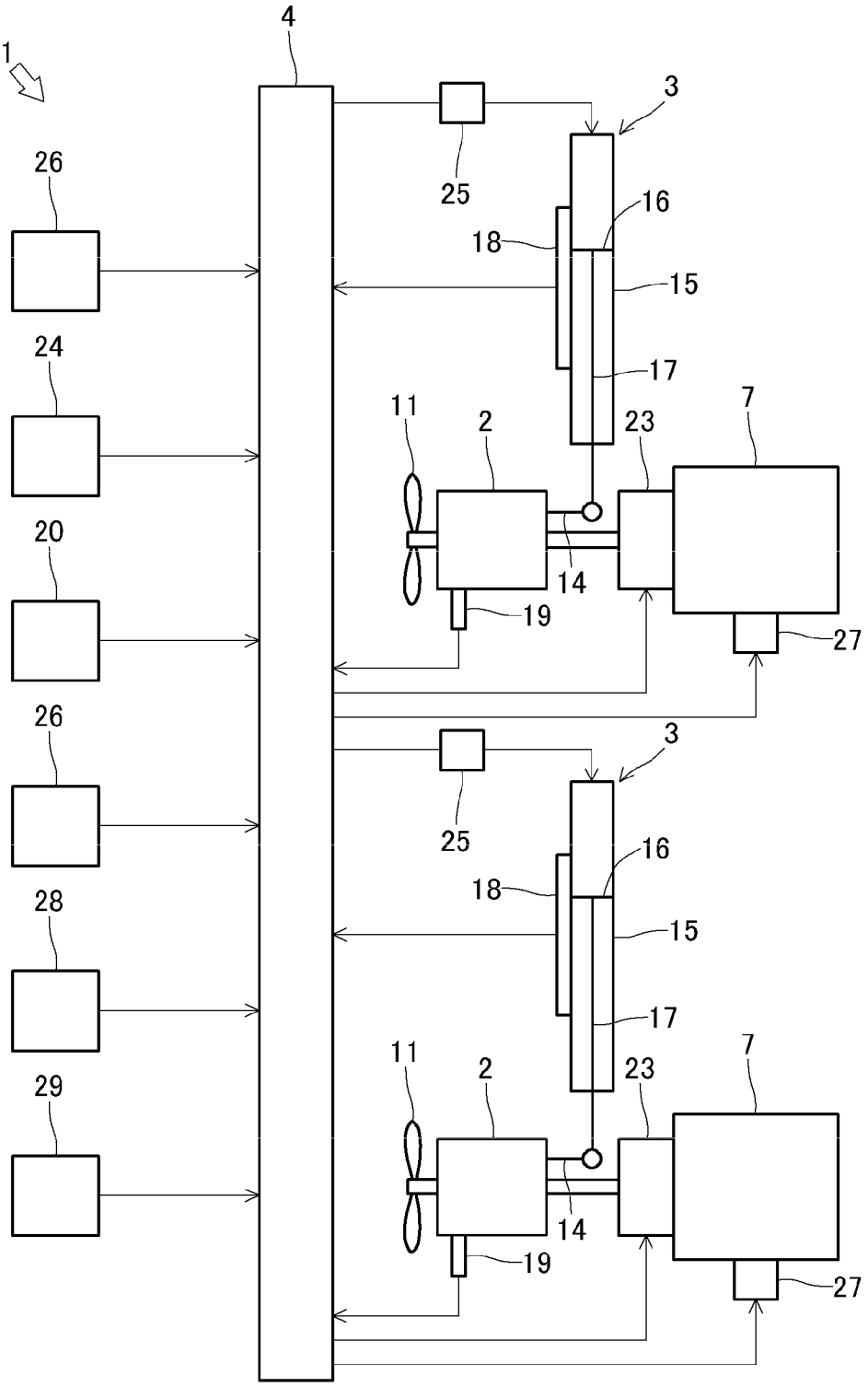
[FIG. 1]

1 maneuvering device
2 outdrive device
4 control device
7 engine
11 propeller
20 joystick lever (operation means)
22 ship
23 main clutch (clutch)
28 very low speed sailing mode button (determination means)
29 changing dial (changing means)
D duty ratio
Ms baseline operation amount
N engine rotation speed
Nlow low idling rotation speed
ΔM increase amount
ΔMs baseline increase amount

DETAILED DESCRIPTION OF THE INVENTION

An explanation will be given on a mode for carrying out the present invention referring to drawings.

Firstly, an explanation will be given on entire construction of a maneuvering device 1 referring to FIGS. 1 to 4.

The maneuvering device 1 is so-called two-shaft (two-device) type having two outdrive devices 2. The maneuvering device 1 includes the outdrive devices 2, hydraulic cylinders 3, a control device 4 and the like.

In each of the outdrive devices 2, one of ends of an input shaft 5 is connected via an universal joint 6 to a power transmission shaft (not shown) of an engine 7 so as to be able to transmit power. Between the engine 7 and the input shaft 5, a main clutch 23 is interposed. Power transmission from the engine 7 to the input shaft 5 is turned on and off (engaged and disengaged) with the main clutch 23. The other end of the input shaft 5 is connected via a switching clutch 8 to an upper end of a drive shaft 9 so as to be able to transmit the power. A rotation direction of the drive shaft 9 is switched with the switching clutch 8. A lower end of the drive shaft 9 is connected to one of ends of a final output shaft 10 so as to be able to transmit the power. On the other end of the final output shaft 10, a propeller 11 is provided.

Each of the outdrive devices 2 is supported pivotally via a gimbal ring 12 by a hull 13 so as to be rotatable laterally. One of ends of a steering arm 14 is connected to the gimbal ring 12. For example, a rotation angle of the outdrive device 2 is 30° for the leftward and 30° for the rightward and the sum total thereof is 60°.

In each of the hydraulic cylinders 3, inside a cylinder sleeve 15, a piston 16 is provided slidably. The piston 16 is connected to one of ends of a rod 17. The other end of the rod 17 is connected to the other end of the steering arm 14. By sending hydraulic oil in a hydraulic oil tank (not shown) to the cylinder sleeve 15, the piston 16 is slid.

The control device 4 has a normal sailing mode and a very low speed sailing mode as a sailing mode of a ship 22. The normal sailing mode and the very low speed sailing mode will be explained in detail later. The control device 4 is connected to a rotation speed sensor 19 detecting a rotation speed of the outdrive device 2 (the propeller 11), a position sensor 18 detecting positions (slid positions) of the pistons 16 of the hydraulic cylinders 3, an electromagnetic valve 25 changing a sending direction of the pressure oil to the hydraulic cylinders 3, a throttle actuator 27 changing a rotation speed of the engine 7, a joystick lever 20, an operation wheel 24, an accelerator lever 26, a very low speed sailing mode button 28 and a changing dial 29. A baseline operation amount Ms and a baseline increase amount ΔMs concerning a duty ratio D and an operation amount of the joystick lever 20 are stored in the control device 4.

The duty ratio D is a ratio of time in which the main clutch 23 has been turned on at a predetermined cycle. Namely, when the predetermined cycle is referred to as T and the time in which the main clutch 23 has been turned on is referred to as T1, the duty ratio D is a value that the time T1 in which the main clutch 23 has been turned on is divided by the predetermined cycle T (T1/T).

The joystick lever 20 is rotatable around an X axis, a Y axis and a Z axis. Namely, the joystick lever 20 can be tilted along a direction of the X axis (a lateral direction) and a direction of the Y axis (a longitudinal direction) and can be twisted around the Z axis. The joystick lever 20 is biased to a neutral position so as to be along a vertical direction when being not operated.

According to the construction, by transmitting power of the engine 7 to the main clutch 23, the universal joint 6, the input shaft 5, the switching clutch 8, the drive shaft 9 and the final output shaft 10, the propeller 11 is rotated. Then, by rotating the propeller 11, propulsion power of the outdrive device 2 is generated.

Then, the control device 4 switches the rotation direction of the drive shaft 9 via the switching clutch 8 corresponding to an operation direction of the joystick lever 20. By switching the rotation direction of the drive shaft 9, forward/rearward sailing of the ship 22 is switched.

The control device 4 changes an opening of a throttle (not shown) of the engine 7 via the throttle actuator 27 corresponding to an operation amount (tilt amount and twist amount) of the joystick lever 20. By changing the throttle opening, the engine rotation speed is changed, whereby the propulsion power of the outdrive device 2 is changed. Similarly, the rotation speed of the engine 7 is changed corresponding to an operation amount of the accelerator lever 26. Namely, the rotation speed of the left engine 7 is changed by operating one of the accelerator levers 26, and the rotation speed of the right engine 7 is changed by operating the other accelerator lever 26.

Furthermore, the control device 4 slides the piston 16 of the hydraulic cylinders 3 via the electromagnetic valves 25 corresponding to the operation amount (tilt amount and twist amount) of the joystick lever 20. By sliding the piston 16, the outdrive device 2 is rotated via the rod 17 and the steering arm 14. Namely, the rotation angle (steering angle) of the outdrive device 2 is changed. Similarly, the outdrive device 2 is rotated corresponding to an operation amount of the operation wheel 24.

Next, an explanation will be given on a maneuvering method of the ship 22 with the maneuvering device 1 referring to FIGS. 5 to 8.

Figure 5:
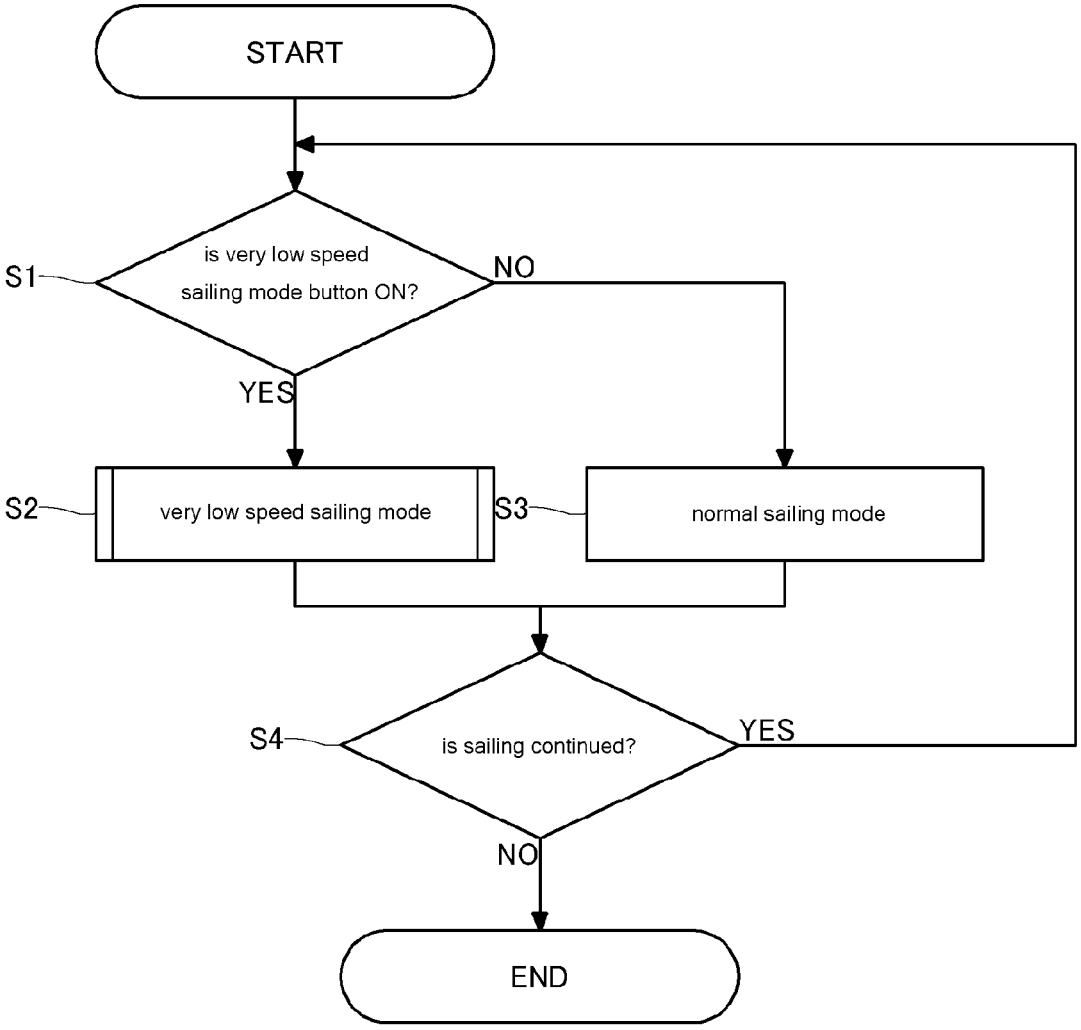
[FIG. 5]

As shown in FIG. 5, when the very low speed sailing mode button 28 is at an ON state (step S1, YES), the sailing mode is the very low speed sailing mode (step S2). On the other hand, when the very low speed sailing mode button 28 is at an OFF state (step S1, NO), the sailing mode is the normal sailing mode (step S3). When the sailing is continued (step S4, YES), the steps from the step S1 are repeated.

Figure 6:
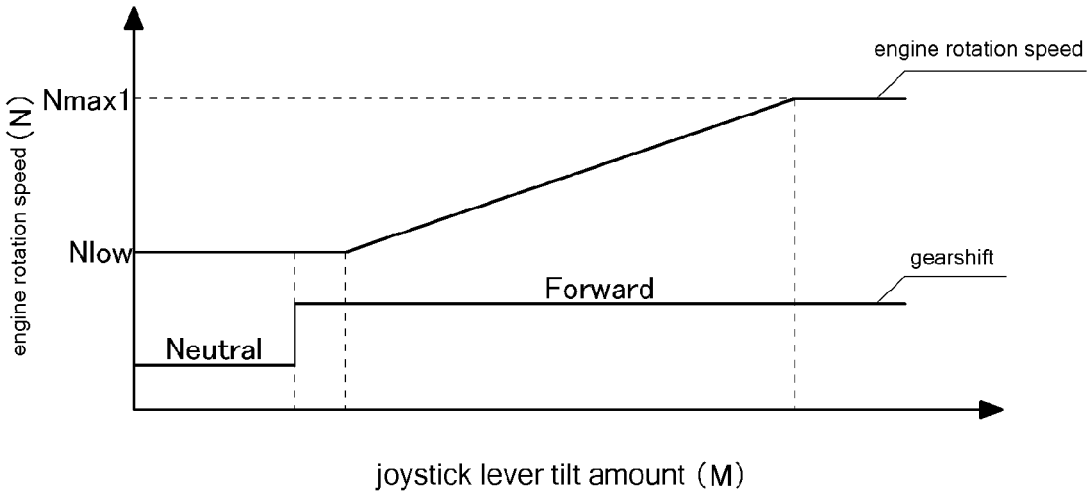
[FIG. 6] FIG. 6(*a*) is a diagram of relation between an inclination amount of the joystick lever and an engine rotation speed at a normal sailing mode.
Figure 6:
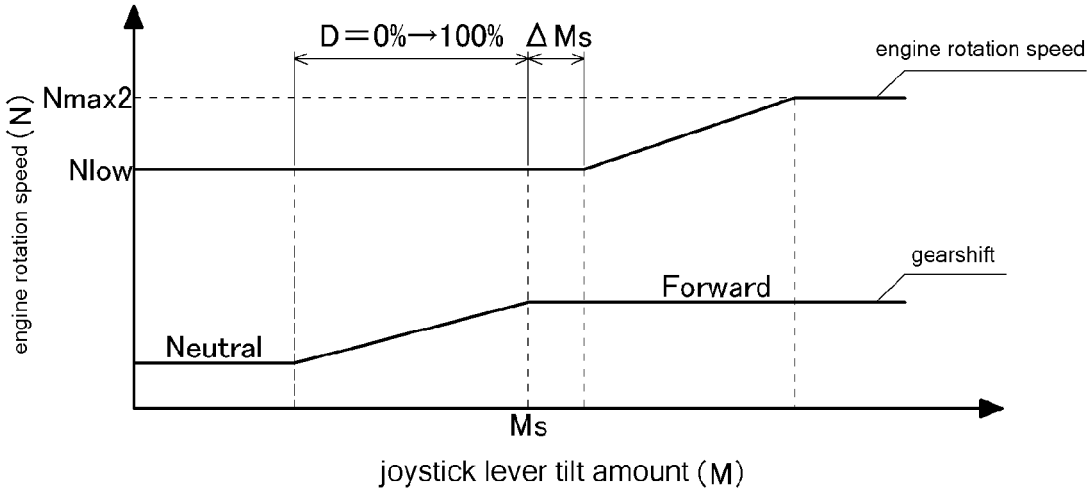

In the case of the normal sailing mode, as shown in FIG. 6(*a*), when gearshift of the main clutch 23 is Neutral, the engine rotation speed N is a low idling rotation speed Nlow regardless of the tilt amount M of the joystick lever 20. When gearshift of the main clutch 23 is Forward, the engine rotation speed N is changed within a range between the low idling rotation speed Nlow and a maximum engine rotation speed Nmax1 corresponding to (proportionally to) the tilt amount M of the joystick lever 20. The low idling rotation speed Nlow is an engine rotation speed at the time of idling of the engine 7.

On the other hand, in the case of the very low speed sailing mode, as shown in FIG. 6(*b*), the baseline operation amount Ms is determined within the range of the tilt amount M of the joystick lever 20. In detail, the baseline operation amount Ms can be changed with the changing dial 29 discussed later. When the tilt amount M of the joystick lever 20 is not more than the baseline operation amount Ms, the engine rotation speed N is maintained at the low idling rotation speed Nlow and the duty ratio D is changed within a range from 0% to 100% corresponding to (proportionally to) the tilt amount M of the joystick lever 20. When the tilt amount M of the joystick lever 20 excesses the baseline operation amount Ms, the duty ratio D is 100% and the engine rotation speed N is changed within a range between the low idling rotation speed Nlow and a maximum engine rotation speed Nmax2 corresponding to (proportionally to) the tilt amount M of the joystick lever 20. However, when an increase amount of the tilt amount M of the joystick lever 20 from the baseline operation amount Ms (hereinafter, simply referred to as "increase amount") ΔM (=M−Ms) is not more than the baseline increase amount ΔMs, the engine rotation speed N is maintained at the low idling rotation speed Nlow.

Figure 7:
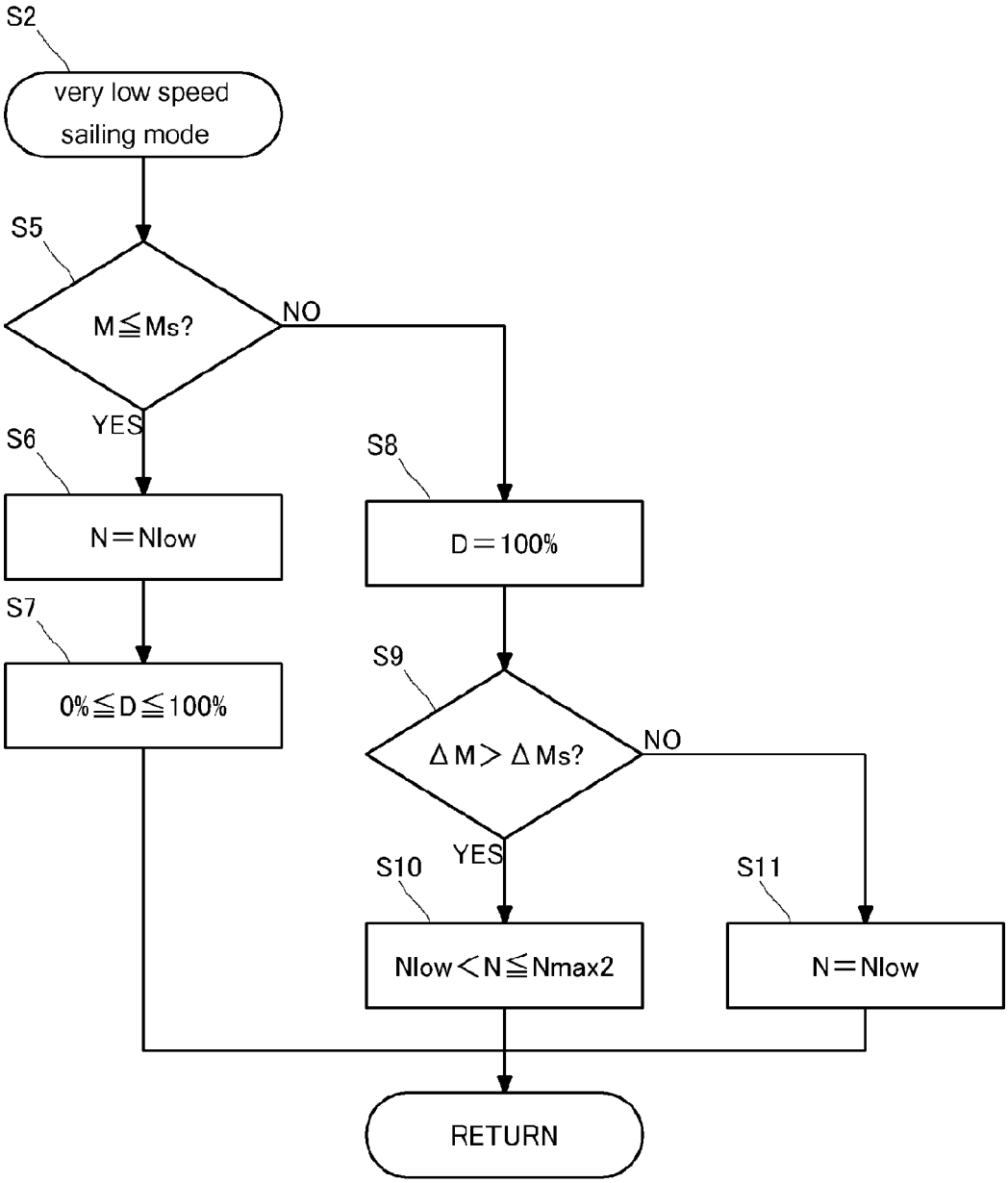
[FIG. 7]

Concretely, as shown in FIG. 7, in the case of the very low speed sailing mode (step S2), at a step S5, whether the tilt amount M of the joystick lever 20 is less than or equal to the baseline operation amount Ms or not is judged.

When the tilt amount M of the joystick lever 20 is not more than the baseline operation amount Ms (step S5, YES), the engine rotation speed N becomes the low idling rotation speed Nlow (step S6) and the duty ratio D is changed within the range from 0% to 100% corresponding to (proportionally to) the tilt amount M of the joystick lever 20 (step S7).

On the other hand, when the tilt amount M of the joystick lever 20 excesses the baseline operation amount Ms (step S5, NO), the duty ratio D becomes 100% (step S8) and whether the increase amount ΔM excesses the baseline increase amount ΔMs or not is judged (step S9).

When the increase amount ΔM excesses the baseline increase amount ΔMs (step S9, YES), the engine rotation speed N is changed within the range between the low idling rotation speed Nlow and the maximum engine rotation speed Nmax2 corresponding to (proportionally to) the tilt amount M of the joystick lever 20 (step S10).

On the other hand, when the increase amount ΔM does not excess the baseline increase amount ΔMs (step S9, NO), the engine rotation speed N is maintained at the low idling rotation speed Nlow (step S11).

Next, an explanation will be given on a relation between the tilt amount M of the joystick lever 20 and the duty ratio D and the engine rotation speed N at the very low speed sailing mode referring to FIG. 8.

Figure 8:
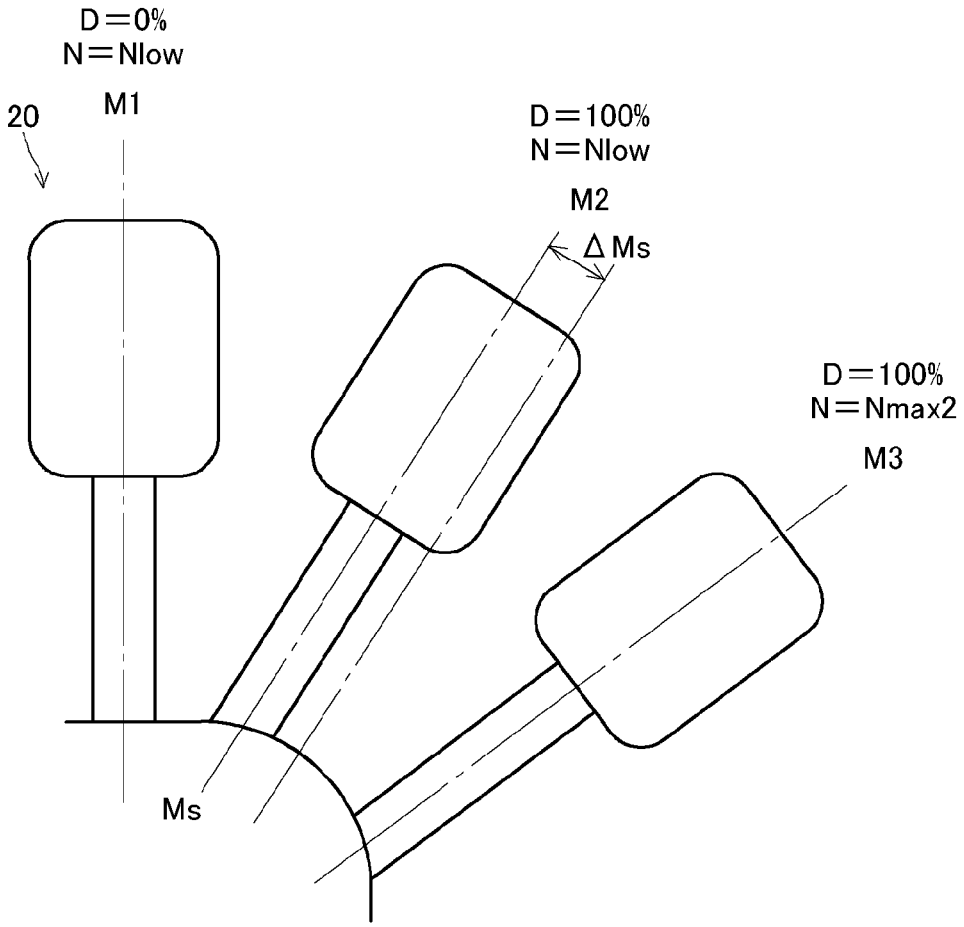
[FIG. 8]

As shown in FIG. 8, when the tilt amount M of the joystick lever 20 is M1 (the joystick lever 20 is not tilted), the duty ratio D is 0% and the engine rotation speed N is the low idling rotation speed Nlow. Following the tilt of the joystick lever 20 from a position of the tilt amount M1, the engine rotation speed N is maintained at the low idling rotation speed Nlow and the duty ratio D is increased from 0%. When the tilt amount M of the joystick lever 20 is M2 (the baseline operation amount Ms), the duty ratio D is 100% and the engine rotation speed N is the low idling rotation speed Nlow.

Namely, when the tilt amount M of the joystick lever 20 is not more than the baseline operation amount Ms, the tilt amount M of the joystick lever 20 is proportional to the duty ratio D. Accordingly, following reduction of the tilt amount M of the joystick lever 20, the duty ratio D is reduced and a sailing speed is reduced, and following approach of the tilt amount M of the joystick lever 20 to the baseline operation amount Ms, the duty ratio D is increased and the sailing speed is increased (the sailing speed approaches to a sailing speed at the time at which the engine rotation speed N is the low idling rotation speed Nlow and the main clutch 23 has been turned on). The sailing speed at the time at which the tilt amount M of the joystick lever 20 is the baseline operation amount Ms is the sailing speed at the time at which the engine rotation speed N is the low idling rotation speed Nlow and the main clutch 23 has been turned on.

Following the tilt of the joystick lever 20 from a position of the tilt amount M2, the duty ratio D is maintained at 100% and the engine rotation speed N is increased from the low idling rotation speed Nlow. As mentioned above, when the increase amount ΔM does not excess the baseline increase amount ΔMs, the engine rotation speed N is maintained at the low idling rotation speed Nlow. When the tilt amount M of the joystick lever 20 is M3 (when the joystick lever 20 is tilted maximally), the duty ratio D is maintained at 100% and the engine rotation speed N is the maximum engine rotation speed Nmax2.

Namely, when the tilt amount M of the joystick lever 20 is within a range from Ms+ΔMs to M3, the duty ratio D is maintained at 100% and the engine rotation speed N is changed within the range between the low idling rotation speed Nlow and the maximum engine rotation speed Nmax2 corresponding to (proportionally to) the tilt amount M of the joystick lever 20. An increase amount (acceleration) of the engine rotation speed N at the time at which the tilt amount M of the joystick lever 20 is within the range from Ms+ΔMs to M3 is substantially the same as an increase amount (acceleration) of the engine rotation speed N at the time at which the tilt amount M of the joystick lever 20 is within the range from M1 to M2 so as to make the acceleration smooth.

Herein, the baseline operation amount Ms can be changed with the changing dial 29. When the baseline operation amount Ms is changed to a side of M1 (a side in which the tilt amount M of the joystick lever 20 is small), a change amount of the duty ratio D (a change amount of the duty ratio D per unit tilt amount of the joystick lever 20) is increased and the acceleration is increased, whereby a maximum sailing speed at the very low speed sailing mode is increased. On the contrary, when the baseline operation amount Ms is changed to a side of M3 (a side in which the tilt amount M of the joystick lever 20 is large), the change amount of the duty ratio D (the change amount of the duty ratio D per unit tilt amount of the joystick lever 20) is reduced and the acceleration is reduced, whereby the maximum sailing speed at the very low speed sailing mode is reduced.

As mentioned above, the ship maneuvering device 1 of the ship 22 has the engine 7, the outdrive device 2 having the propeller 11 rotated by the power of the engine 7, the main clutch 23 which is a clutch engaging and disengaging the power transmission from the engine 7 to the propeller 11, the joystick lever 20 which is an operation means actuating the outdrive device 2, and the control device 4 connected to the engine 7, the main clutch 23 and the joystick lever 20. The control device 4 has the very low speed sailing mode. The control device 4 is connected to the very low speed sailing mode button 28 which is a determination means determining whether the very low speed sailing mode is executed or not. In the case in which the execution of the very low speed sailing mode is determined, when the operation amount of the joystick lever 20 is not more than the baseline operation amount Ms, the control device 4 makes the engine rotation speed N be the low idling rotation speed Nlow and changes the duty ratio D, which is a ratio of the time T1 in which the main clutch 23 at the predetermined cycle T has been turned on corresponding to the operation amount of the joystick lever 20, within the range not more than 100%.

According to the construction, by executing the very low speed sailing mode, the main clutch 23 is engaged and disengaged while the engine 7 is rotated at the low idling rotation speed Nlow, whereby sailing at a speed lower than the sailing speed at the low idling rotation speed Nlow of the engine 7 is enabled so as to make maneuvering of the ship easy. Since the sailing speed is changed by changing the duty ratio D corresponding to the operation amount of the joystick lever 20, the sailing speed can be changed following a sailing situation so as to make the maneuvering of the ship easy. For example, at the time of berthing and unberthing of the ship 22, too high sailing speed is prevented which makes the maneuvering of the ship at the time of berthing and unberthing difficult for an unskilled operator unfamiliar to the maneuvering of the ship. Namely, the unskilled operator unfamiliar to the maneuvering of the ship can perform the berthing and unberthing easily.

When the operation amount of the joystick lever 20 excesses the baseline operation amount Ms, the control device 4 makes the duty ratio D be 100% and increases the engine rotation speed N from the low idling rotation speed Nlow corresponding to the operation amount of the joystick lever 20.

According to the construction, by operating the joystick lever 20, the engine rotation speed N is increased from the low idling rotation speed Nlow, whereby the sailing speed can be increased following the sailing situation so as to make the maneuvering of the ship easy further.

When the increase amount ΔM of the operation amount of the joystick lever 20 concerning the baseline operation amount Ms is not higher than the baseline increase amount ΔMs, the control device 4 maintains the engine rotation speed N at the low idling rotation speed Nlow.

According to the construction, for the time being after the operation amount of the joystick lever 20 excesses the baseline operation amount Ms, the engine rotation speed N is maintained at the low idling rotation speed Nlow, whereby the operator is not panicked by sudden change of the engine rotation speed N and the maneuvering of the ship becomes easy further.

Furthermore, the control device 4 is connected to the changing dial 29 which is a changing means changing the baseline operation amount Ms.

According to the construction, by changing the baseline operation amount Ms following the sailing situation, the maneuvering of the ship can be made easy further. Namely, by changing the baseline increase amount ΔMs, maneuvering feeling can be fitted to the operator.

The determination means according to the present invention is not limited to the very low speed sailing mode button 28 according to this embodiment. For example, the determination means according to the present invention may alternatively be a lever.

The changing means according to the present invention is not limited to the changing dial 29 according to this embodiment. For example, the changing means according to the present invention may alternatively be a lever.

Next, an explanation will be given on the ship maneuvering device of the ship in detail from another viewpoint.

Figure 2:
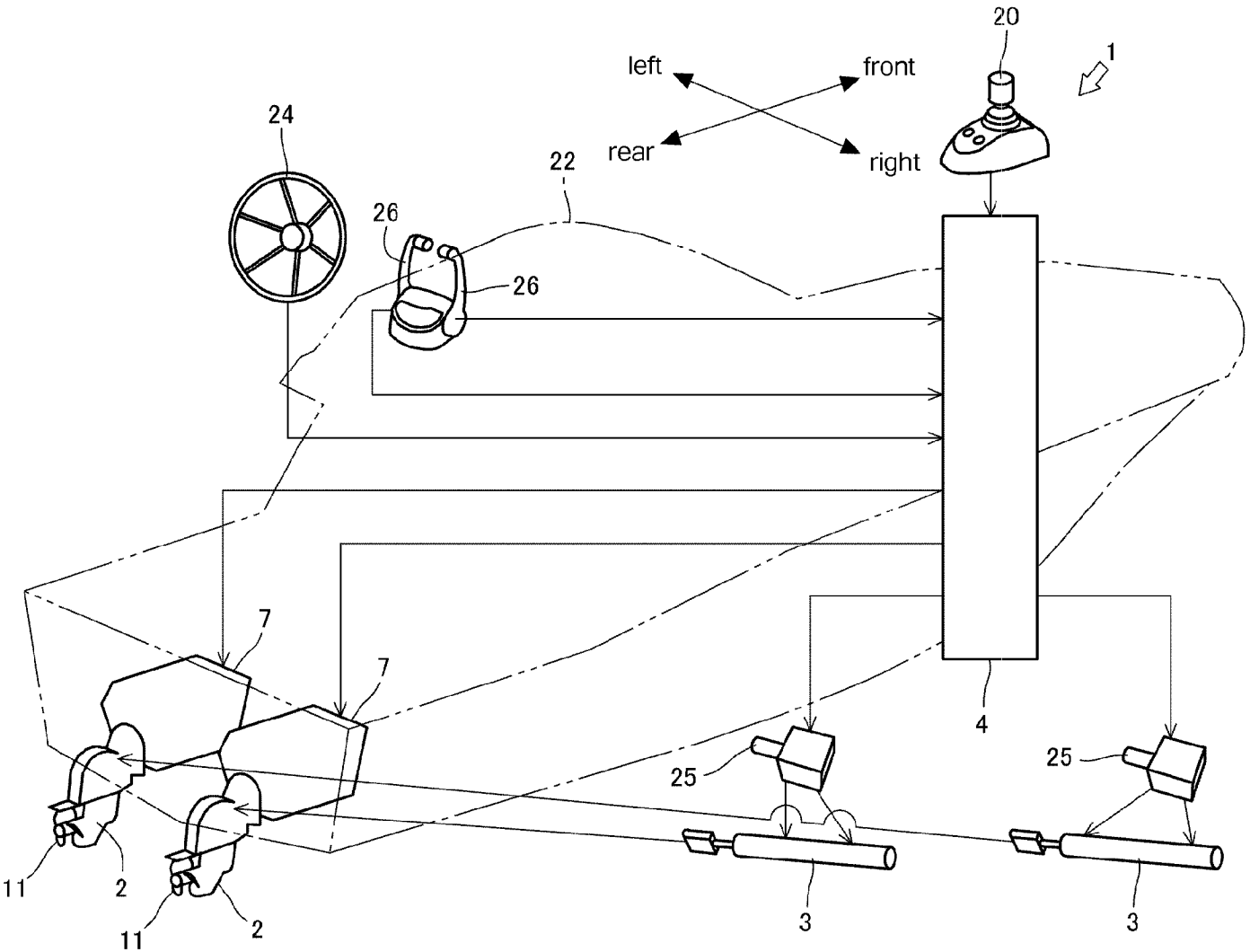
[FIG. 2]
Figure 3:
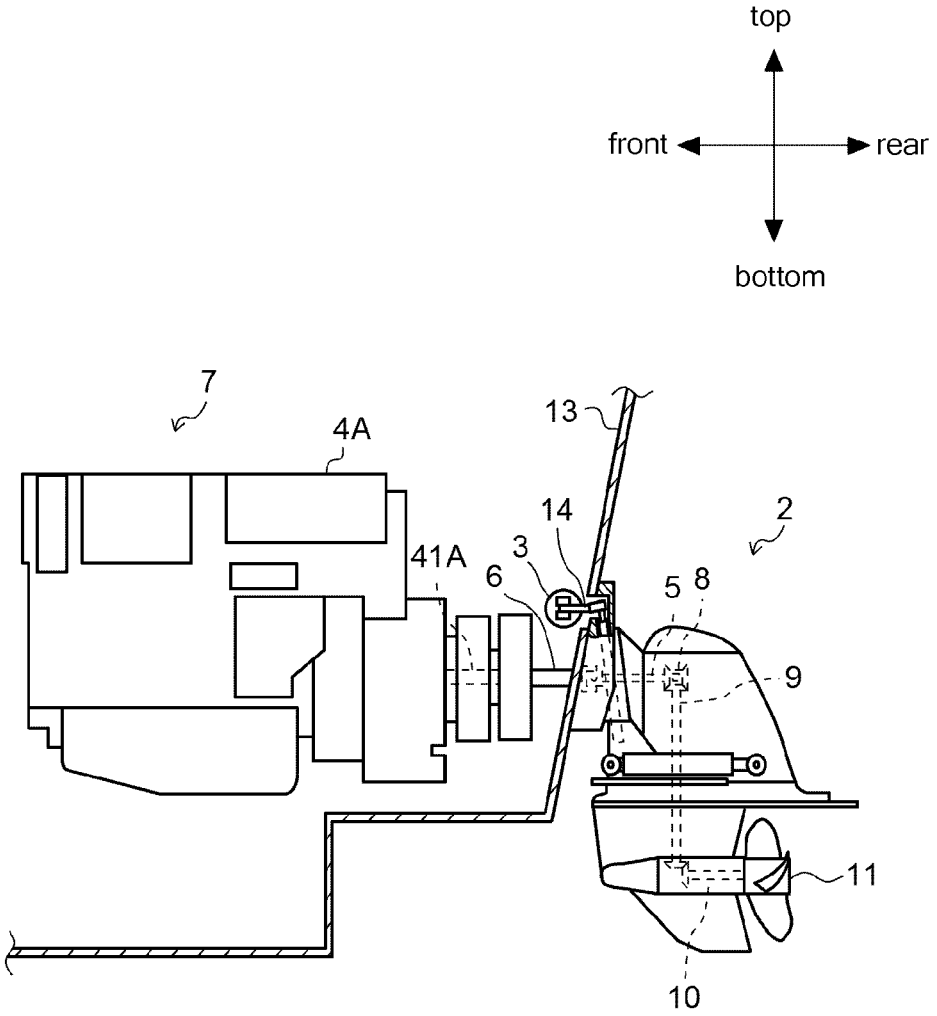
[FIG. 3]
Figure 9:
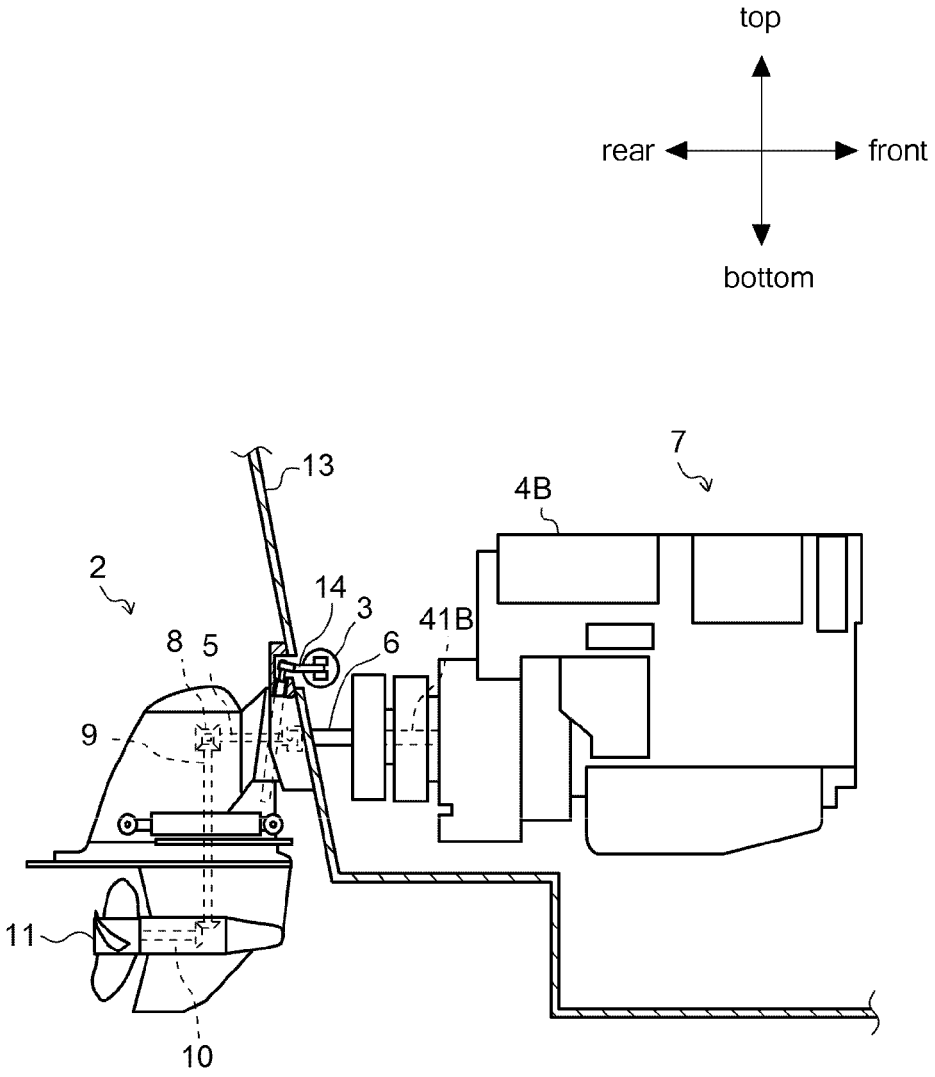
[FIG. 9]
Figure 10:
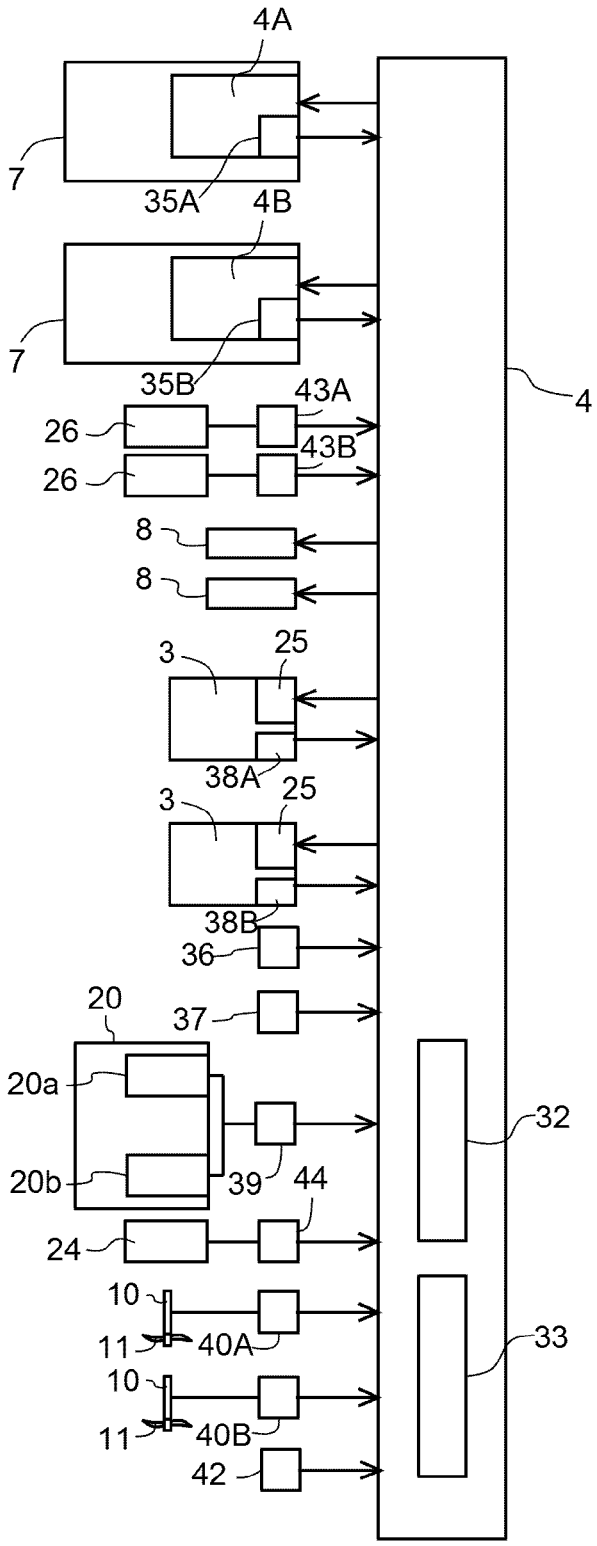
[FIG. 10]

As shown in FIGS. 2, 3 and 9, the ship maneuvering device 1 of the ship has the pair of left and right engines 7, rotation speed changing actuators 4A and 4B independently changing engine rotation speeds $N_A$ and $N_B$ of the pair of left and right engines 7, the pair of left and right outdrive devices 2 respectively connected to the pair of left and right engines 7 and rotating the propellers 11 so as to propel the ship 22, the switching clutches 8 disposed between the engines 7 and the propellers 11, the pair of left and right hydraulic steering cylinders 3 respectively independently rotating the pair of left and right outdrive devices 2 laterally, the electromagnetic valves 25 controlling hydraulic pressure in the hydraulic cylinders 3, the joystick 20, the accelerator lever 26 and the operation wheel 24 as operation means setting the traveling direction of the ship, the operation amount detection sensor 39 as an operation amount detection means detecting the operation amount of the joystick 20 (see FIG. 10), operation amount detection sensors 43A and 43B as operation amount detection means detecting the operation amount of the accelerator lever 26 (see FIG. 10), an operation amount detection sensor 44 as an operation amount detection means detecting the operation amount of the operation wheel 24 (see FIG. 10), and the control device 4 controlling the rotation speed changing actuators 4A and 4B, the switching clutches 8, the hydraulic steering cylinders 3 and the electromagnetic valves 25 so as to travel to a direction set by the joystick 20, the accelerator lever 26 and the operation wheel 24 (see FIG. 10).

The engines 7 are arranged in a rear portion of the ship 22 as a pair laterally, and are connected to the outdrive devices 2 arranged outside the ship. The engines 7 have output shafts 41A and 41B for outputting rotation power.

The rotation speed changing actuators 4A and 4B are means controlling the engine rotation power, and changes a fuel injection amount of a fuel injection device and the like so as to control engine rotation speeds of the engines 7.

The outdrive devices 2 are propulsion devices rotating the propellers 11 so as to propel the ship 22, and are provided outside the rear portion of the ship 22 as a pair laterally. The pair of left and right outdrive devices 2 are respectively connected to the pair of left and right engines 7. The outdrive devices 2 are rudder devices which are rotated concerning the traveling direction of the ship 22 so as to make the ship 22 turn. The outdrive devices 2 mainly include input shafts 5, the switching clutches 8, drive shafts 9, final output shaft 10, and the rotating propellers 11.

The input shafts 5 transmit rotation power. In detail, the input shafts 5 transmit rotation power of the engines 7, transmitted from the output shafts 41A and 41B of the engines 7 via universal joints 6, to the switching clutches 8. One of ends of each of the input shafts 5 is connected to corresponding one of the universal joints 6 attached to the output shafts 41A and 41B of the engines 7, and the other end thereof is connected to corresponding one of the switching clutches 8.

The switching clutches 8 are arranged between the engines 7 and the rotating propellers 11, and switch rotation direction of the rotation power. In detail, the switching clutches 8 are rotation direction switching devices which switch the rotation power of the engines 7, transmitted via the input shafts 5 and the like, to forward or reverse direction. The switching clutches 8 have forward bevel gears and reverse bevel gears which are connected to inner drums having disc plates, and pressure plates of outer drums connected to the input shafts 5 is pressed against the disc plates of the forward bevel gears or the reverse bevel gears so as to switch the rotation direction.

The drive shafts 9 transmit the rotation power. In detail, the drive shafts 9 are rotation shafts which transmit the rotation power of the engines 7, transmitted via the switching clutches 8 and the like, to the final output shaft 10. A bevel gear provided at one of ends of each of the drive shafts 9 is meshed with the forward bevel gear and the reverse bevel gear provided on corresponding one of the switching clutches 8, and a bevel gear provided at the other end is meshed with a bevel gear provided on corresponding one of the final output shaft 10.

The final output shafts 10 transmit the rotation power. In detail, the final output shaft 10 are rotation shafts which transmit the rotation power of the engines 7, transmitted via the drive shafts 9 and the like, to the propellers 11. As mentioned above, the bevel gear provided at one of ends of each of the final output shaft 10 is meshed with the bevel gear of corresponding one of the drive shafts 9, and the other end is attached thereto with corresponding one of the propellers 11.

The propellers 11 are rotated so as to generate propulsion power. In detail, the propellers 11 are driven by the rotation power of the engines 7 transmitted via the final output shaft 10 and the like so that a plurality of blades arranged around the rotation shafts paddle surrounding water, whereby the propulsion power is generated.

The hydraulic steering cylinders 3 are hydraulic devices which drive steering arms 14 so as to rotate the outdrive devices 2. The hydraulic steering cylinders 3 are provided therein with the electromagnetic valves 25 for controlling hydraulic pressure, and the electromagnetic valves 25 are connected to the control device 4.

The hydraulic steering cylinders 3 are so-called single rod type hydraulic actuators. However, the hydraulic steering cylinders 3 may alternatively be double rod type.

The joystick 20 as the operation means is a device determining the traveling direction of the ship, and is provided near an operator's seat of the ship 22. A plane operation surface of the joystick 20 is an oblique sailing component determination part 20*a*, and a torsion operation surface thereof is a turning component determination part 20*b*.

Figure 4:
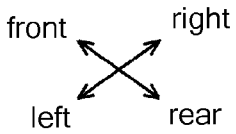
[FIG. 4]
Figure 4:
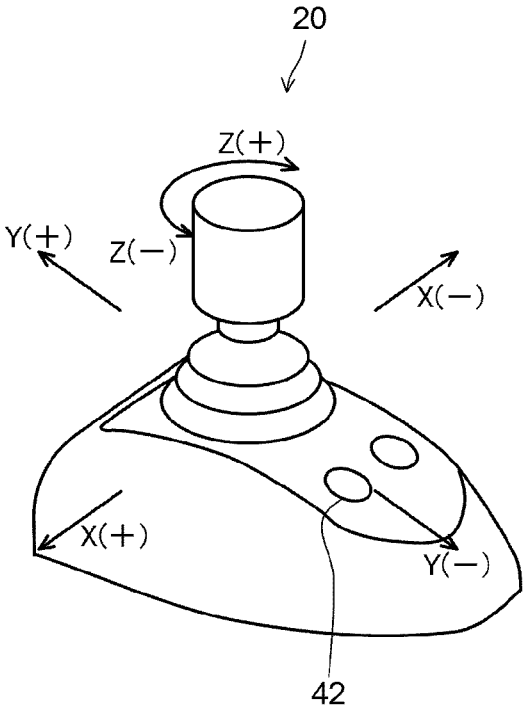

The joystick 20 can be moved free within the operation surface parallel to an X-Y plane shown in FIG. 4, and a center of the operation surface is used as a neutral starting point. Longitudinal and lateral directions in the operation surface correspond to the traveling direction, and an inclination amount of the joystick 20 corresponds to a target hull speed. The target hull speed is increased corresponding to increase of the inclination amount of the joystick 20.

The torsion operation surface is provided with the joystick 20, and by twisting the joystick 20 concerning a Z axis extended substantially perpendicularly to the plane operation surface as a turning axis, a turning speed can be changed. A torsion amount of the joystick 20 corresponds to a target turning speed. A maximum target lateral turning speed is set at fixed turning angle positions of the joystick 20.

The accelerator levers 26 as the operation means are devices determining the target hull speed of the ship, and are provided near the operator's seat of the ship 22. The two accelerator levers 26 are provided so as to correspond respectively to the left and right engines 7. The rotation speed of the engine 7 is changed by operating one of the accelerator levers 26, and the rotation speed of the engine 7 is changed by operating the other accelerator lever 26.

The operation wheel 24 as the operation means is a device determining the traveling direction of the ship, and is provided near the operator's seat of the ship 22. The traveling direction is changed widely following increase of a rotation amount of the operation wheel 24.

A correction control start switch 42 (see FIG. 10) is a switch for starting correction control of turning action of the ship 22.

The correction control start switch 42 is provided near the joystick 20 and is connected to the control device 4.

Next, an explanation will be given on various kinds of detection means referring to FIG. 10.

Rotation speed detection sensors 35A and 35B as rotation speed detection means are means for detecting engine rotation speeds $N_A$ and $N_B$ of the engines 7 and are provided in the engines 7.

An elevation angle sensor 36 as an elevation angle detection means is a means for detecting an elevation angle a of the ship 22. The elevation angle indicates inclination of the hull in the water concerning a flow.\

A hull speed sensor 37 as a hull speed detection means is a means for detecting a hull speed V, and is an electromagnetic log, a Doppler sonar or a GPS for example.

Lateral rotation angle detection sensors 38A and 38B as lateral rotation angle detection means are means for detecting lateral rotation angles $\theta_A$ and $\theta_B$ of the outdrive devices 2. The lateral rotation angle detection sensors 38A and 38B are provided near the hydraulic steering cylinders 3, and detect the lateral rotation angles $\theta_A$ and $\theta_B$ of the outdrive devices 2 based on the drive amounts of the hydraulic steering cylinders 3.

The operation amount detection sensor 39 as the operation amount detection means is a sensor for detecting the operation amount in the plane operation surface and the operation amount in the torsion operation surface of the joystick 20. The operation amount detection sensor 39 detects an inclination angle and an inclination direction of the joystick 20. The operation amount detection sensor 39 detects the torsion amount of the joystick 20.

The operation amount detection sensors 43A and 43B as the operation amount detection means are sensors for detecting the operation amounts of the accelerator levers 26. The operation amount detection sensors 43A and 43B detect inclination angles of the accelerator levers 26.

The operation amount detection sensor 44 as the operation amount detection means is a sensor for detecting the operation amount of the operation wheel 24. The operation amount detection sensor 44 detects the rotation amount of the operation wheel 24.

Outdrive device rotation speed detection sensors 40A and 40B as rotation speed detection means of the outdrive devices 2 are sensors for detecting rotation speeds of the propellers 11 of the outdrive devices 2, and are provided at middle portions of the final output shaft 10. The outdrive device rotation speed detection sensors 40A and 40B detect outdrive device rotation speeds $ND_A$ and $ND_B$.

The control device 4 controls the rotation speed changing actuators 4A and 4B, the switching clutches 8 and the hydraulic steering cylinders 3 so that the ship travels to the direction set by the joystick 20. The control device 4 is connected respectively to the rotation speed changing actuators 4A and 4B, the switching clutches 8, the hydraulic steering cylinders 3, the electromagnetic valves 25, the joystick 20, the accelerator levers 26, the operation wheel 24, the rotation speed detection sensors 35A and 35B, the elevation angle sensor 36, the hull speed sensor 37, the lateral rotation angle detection sensors 38A and 38B, the operation amount detection sensor 39, the operation amount detection sensors 43A and 43B, the operation amount detection sensor 44, and the outdrive device rotation speed detection sensors 40A and 40B. The control device 4 includes a calculation means 32 having a CPU (central processing unit) and a storage means 33 such as a ROM, a RAM or a HDD.

Figure 11:
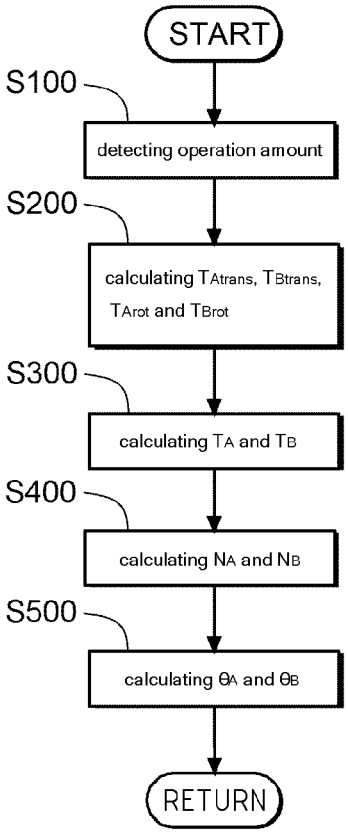
[FIG. 11]

Next, an explanation will be given on a method for calculating the propulsion powers and directions of the left and right outdrive devices 2 with the control device 4 referring to FIG. 11.

Firstly, an operation amount of the joystick 20 is detected (step S100), and based on the operation amount of the joystick 20, oblique sailing component propulsion power vectors $T_{Atrans}$ and $T_{Btrans}$ for the oblique sailing and turning component propulsion power vectors $T_{Arot}$ and $T_{Brot}$ for the turning of the left and right outdrive devices 2 are calculated respectively (step S200).

Figure 12:
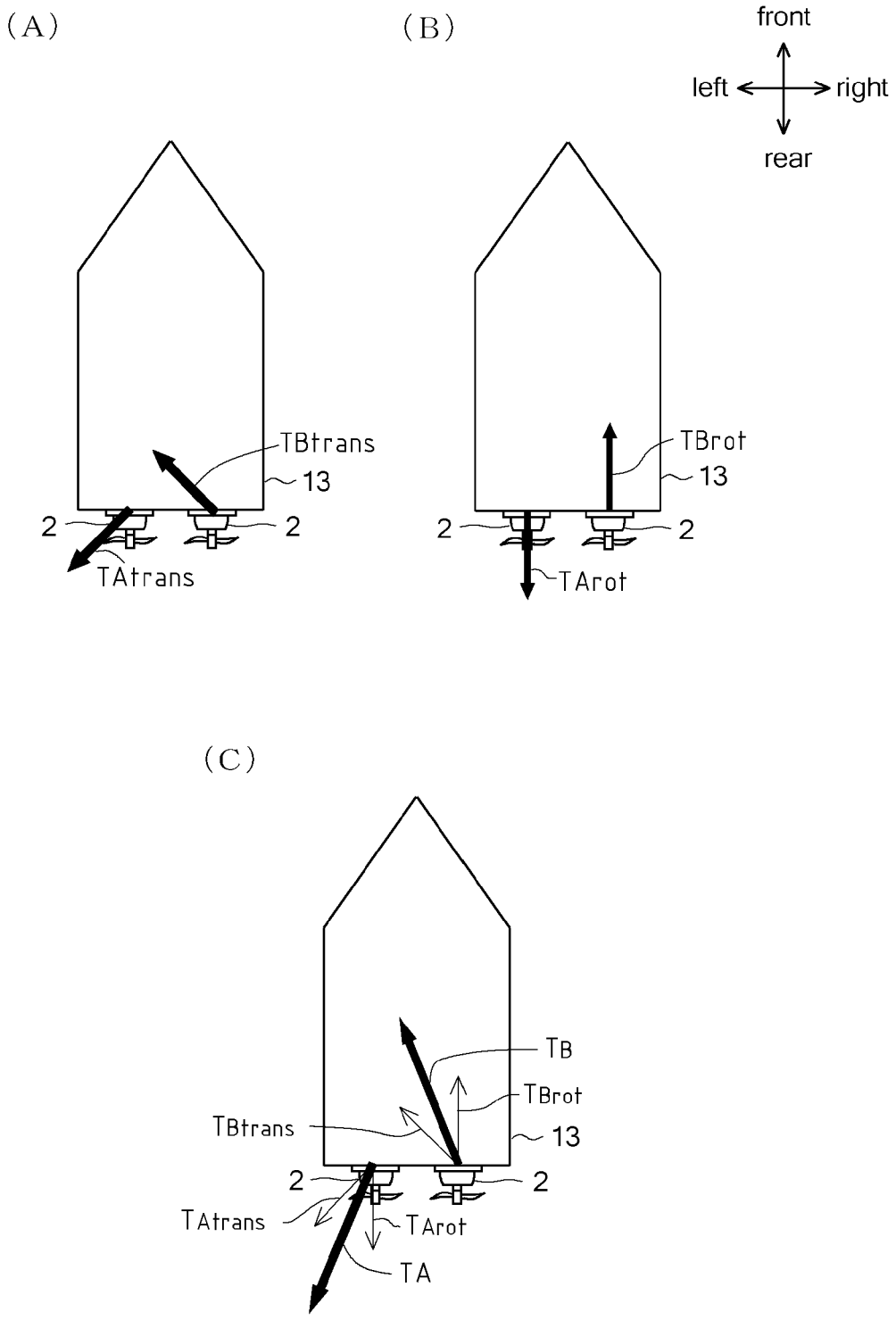
[FIG. 12]

The operation amount of the joystick 20 is the inclination angle, the inclination direction and a torsion amount of the joystick 20, and detected with the operation amount detection sensor 39. Then, based on the operation amounts, the control device 4 calculates the oblique sailing component propulsion power vectors $T_{Atrans}$ and $T_{Btrans}$ for the oblique sailing and the turning component propulsion power vectors $T_{Arot}$ and $T_{Brot}$ for the turning of the left and right outdrive devices 2. The oblique sailing component propulsion power vectors $T_{Atrans}$ and $T_{Btrans}$ of the left and right outdrive devices 2 are calculated as shown in FIG. 12(A). The turning component propulsion power vectors $T_{Arot}$ and $T_{Brot}$ of the left and right outdrive devices 2 are calculated as shown in FIG. 12(B).

Next, the oblique sailing component propulsion power vectors $T_{Atrans}$ and $T_{Btrans}$ and the turning component propulsion power vectors $T_{Arot}$ and $T_{Brot}$ of the left and right outdrive devices 2 are composed respectively so as to calculate the propulsion powers and the directions of the left and right outdrive devices 2 (step S300).

As shown in FIG. 12(C), vectors $T_A$ and $T_B$ are calculated by composing the oblique sailing component propulsion power vectors $T_{Atrans}$ and $T_{Btrans}$ and the turning component propulsion power vectors $T_{Arot}$ and $T_{Brot}$ of the left and right outdrive devices 2 calculated at the step S200.

Next, based on norms of the composited vectors $T_A$ and $T_B$, the control device 4 calculates a rotation speed N of each of the left and right engines 7 (step S40), the switching clutches 8 are switched, and the left and right engines 7 are driven. Based on the directions of the composited vectors $T_A$ and $T_B$, the lateral rotation angles $\theta_A$ and $\theta_B$ of the outdrive devices 2 are calculated respectively (step S500), and the hydraulic steering cylinders 3 are driven.

Next, an explanation will be given on a process of restriction of the lateral rotation angles of the pair of left and right outdrive devices 2 at the calculation of the rotation angles $\theta_A$ and $\theta_B$ at the step S500. Since the same process is performed concerning the pair of left and right outdrive devices 2, the process of restriction of the lateral rotation angle of the one outdrive device 2 is described.

When the angle (direction) $\beta$ of the composition vectors $T_A$ is within a range over a predetermined angle range of the outdrive device 2 at the step S500 in the flow chart, the outdrive device 2 is controlled so as to be at a predetermined limiting angle mode.

Figure 13:
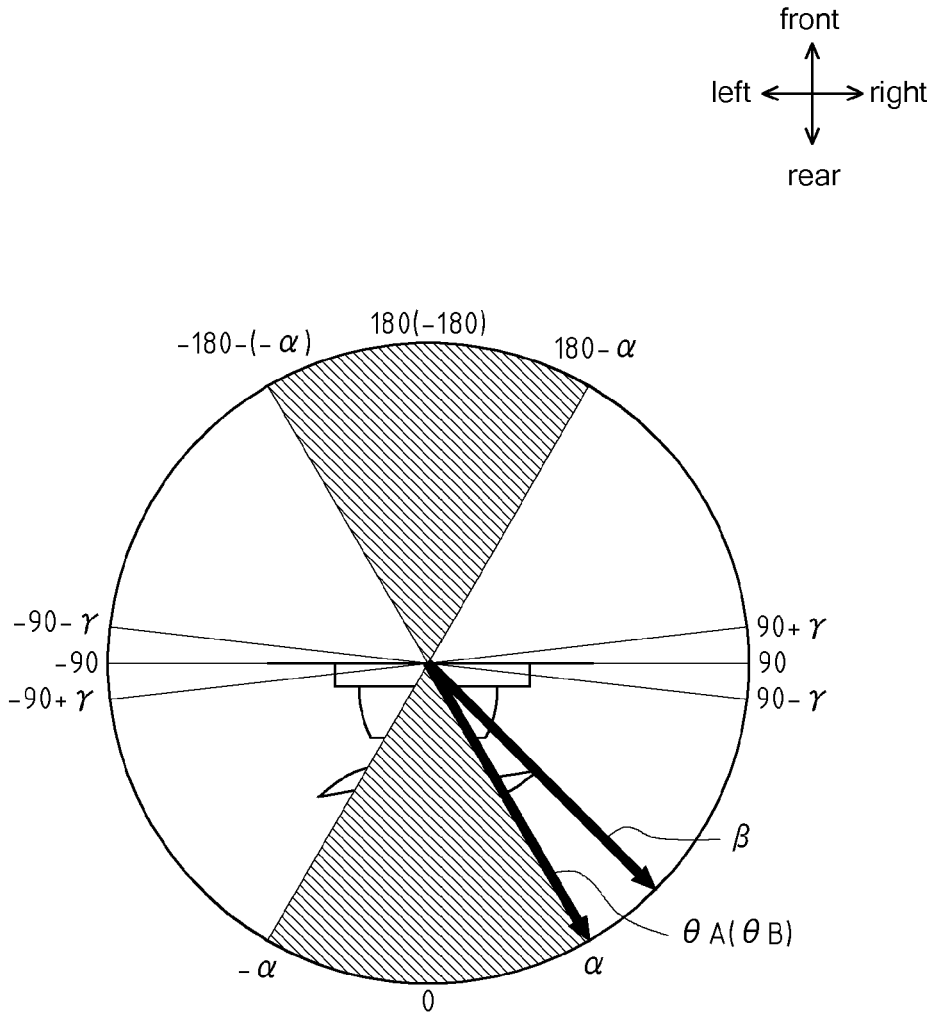
[FIG. 13]

Herein, the predetermined angle range is a range shown with slashes in FIG. 13, and is an angle range in which the outdrive device 2 can be rotated. Since the hydraulic steering actuator 17A is constructed by a hydraulic cylinder and its rotation range is limited, the predetermined angle range is provided. When the predetermined angle range is referred to as $\theta_1$, a limiting angle is referred to as $\alpha$, and the rear side is regarded as 0°, the relation thereof is $-\alpha<\theta_1\leq\alpha$. Since the rotation of the engine 7 can be switched between forward and reverse rotations with the forward/reverse switching clutch 16A, centering on the front side, in other words, 180° (−180°), the lateral angle is $-180°<\theta_1\leq180°-(-\alpha)$, $180°-\alpha<\theta_1\leq180°$. For example, when $\alpha$ is 30°, the predetermined angle range is $-180°<\theta_1\leq-150°$, $-30°<\theta_1\leq30°$, $150°<\theta_1\leq180°$.

Next, an explanation will be given on the limiting angle mode.

Figure 14:
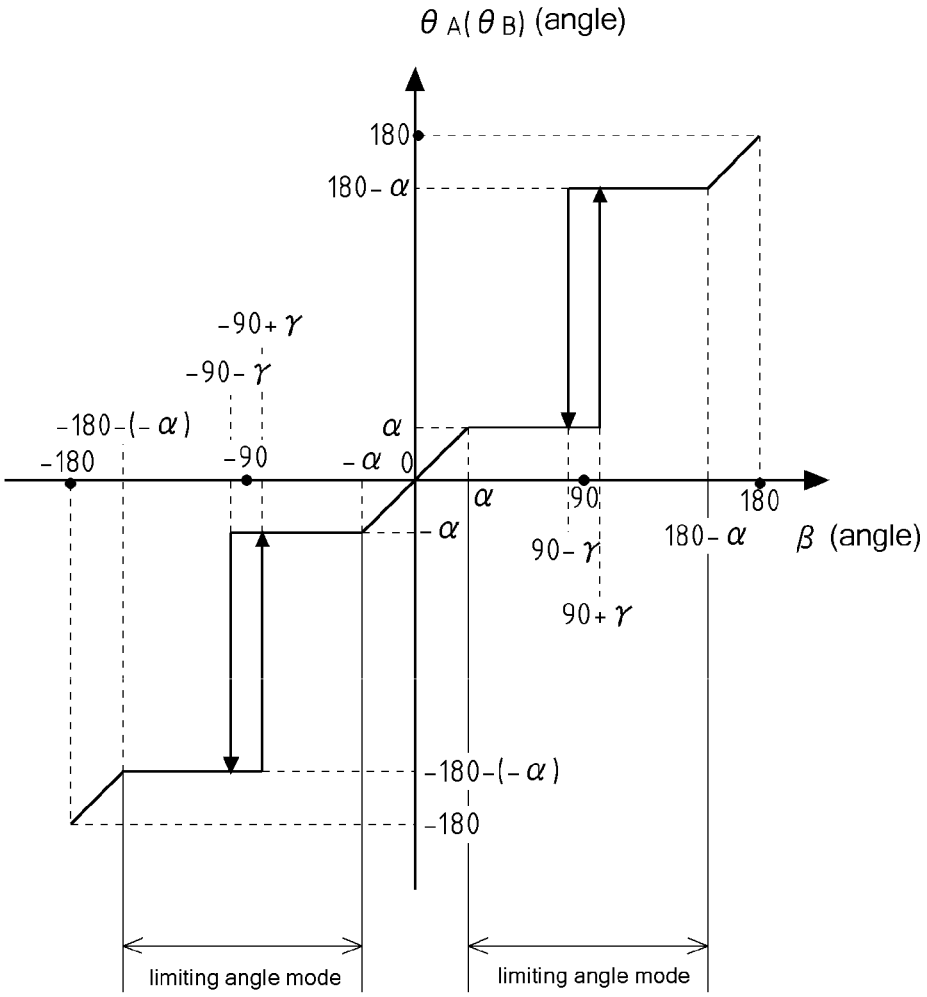
[FIG. 14]

In the limiting angle mode, for obtaining smooth action following the operation of the joystick 20, the driving is performed with reduced propulsion power. Namely, the engine rotation speed $N_A$ is reduced to a set rotation speed $N_{set}$. In the limiting angle mode, the rotation angle $\theta_A$ of the outdrive device 2 is fixed at a state of a predetermined limiting angle. Concretely, by the angle (direction) $\beta$ of the composition vectors $T_A$ determined with the control device 4, the lateral rotation angle $\theta_A$ of the outdrive device 2 is determined. As shown in FIG. 14, in the case in which an X axis indicates the angle $\beta$ of the composition vector $T_A$ and a Y axis indicates the lateral rotation angle $\theta_A$ of the outdrive device 2, when the angle $\beta$ of the composition vector T is within a range of $-180°-(-\alpha)<\beta\leq-90°$, the lateral rotation angle $\theta_A$ of the outdrive device 2 is $-180°-(-\alpha)$. When the angle $\beta$ of the composition vector T is within a range of $-90°<\beta\leq-\alpha$, the lateral rotation angle $\theta_A$ of the outdrive device 2 is $(-\alpha)$. When the angle $\beta$ of the composition vector $T_A$ is within a range of $\alpha<\beta\leq90°$, the lateral rotation angle $\theta_A$ of the outdrive device 2 is $\alpha$. When the angle $\beta$ of the composition vector $T_A$ is within a range of $90°<\beta\leq180°-\alpha$, the lateral rotation angle $\theta_A$ of the outdrive device 2 is $180°-\alpha$.

As shown in FIG. 14, in the limiting angle mode, a play tolerance (hysteresis) is set so as to prevent frequent change of the rotation angle $\theta_A$ of the outdrive device 2.

In the case in which the angle $\beta$ of the composition vector $T_A$ is within a range of $-180°-(-\alpha)<\beta\leq90°$, when the angle $\beta$ of the composition vector $T_A$ is larger than $-90°+\gamma$, the rotation angle $\theta_A$ of the outdrive device 2 is $(-\alpha)$. In the case in which the angle $\beta$ of the composition vector $T_A$ is within a range of $-90°<\beta\leq-\alpha$, when the angle $\beta$ of the composition vector $T_A$ is not more than $-90°-\gamma$, the rotation angle $\theta_A$ of the outdrive device 2 is $-180°-(-\alpha)$.

In the case in which the angle $\beta$ of the composition vector $T_A$ is within a range of $\alpha<\beta\leq90°$, when the angle $\beta$ of the composition vector $T_A$ is larger than $90°+\gamma$, the rotation angle $\theta_A$ of the outdrive device 2 is $180°-\alpha$. In the case in which the angle $\beta$ of the composition vector $T_A$ is within a range of $90° < \beta \leq 180° - \alpha$, when the direction of the composition vector $T_A$ is not more than $90° - \gamma$, the rotation angle $\theta_A$ of the outdrive device 2 is $\alpha$.

In the limiting angle mode, the engine rotation speed $N_A$ of the engine 7 may alternatively be reduced following reduction of a minor angle between the direction of the composition vector $T_A$ and the lateral direction of the ship 22. Following the reduction of the angle between the direction of the composition vector $T_A$ and the lateral direction of the hull (90° and −90°), that is, following approach of the angle $\beta$ of the composition vector $T_A$ to 90° or −90°, the engine rotation speed $N_A$ of the engine 7 is reduced.

Figure 15:
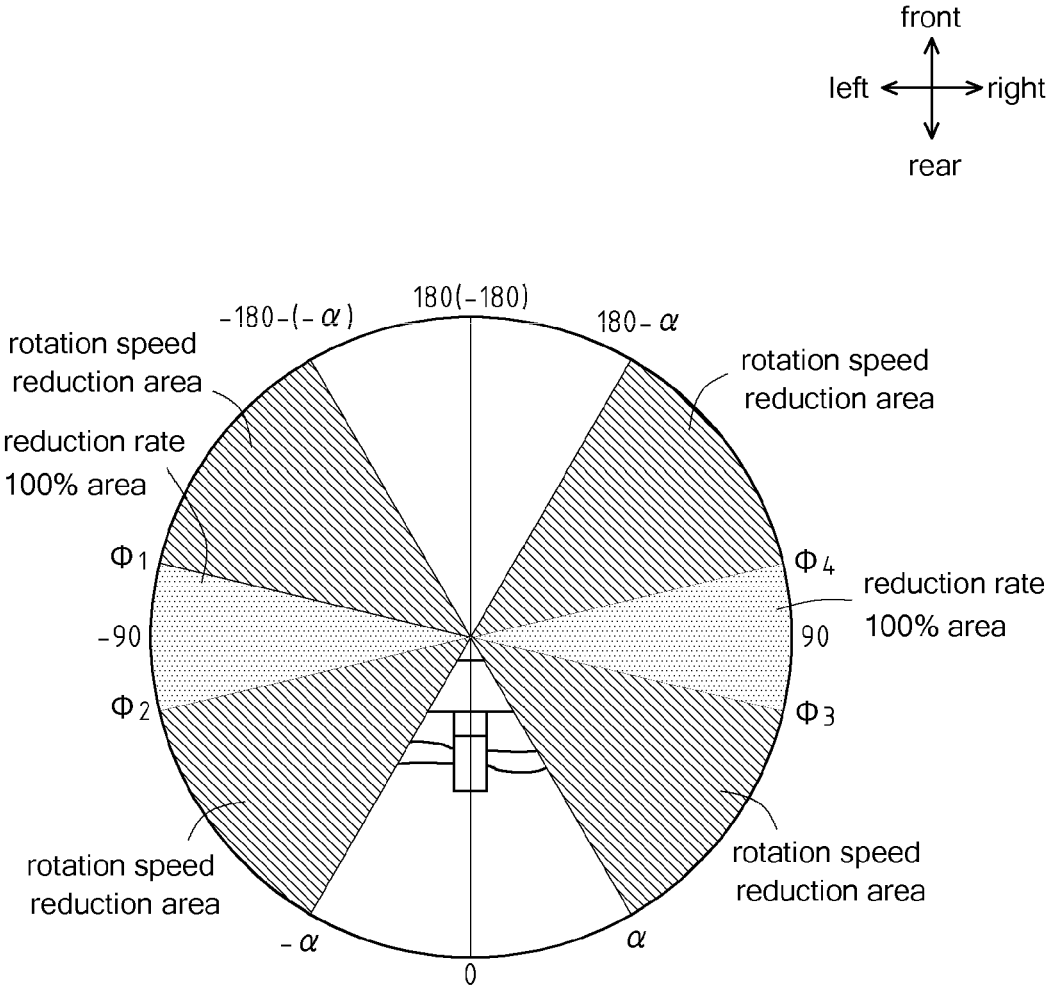
[FIG. 15]
Figure 16:
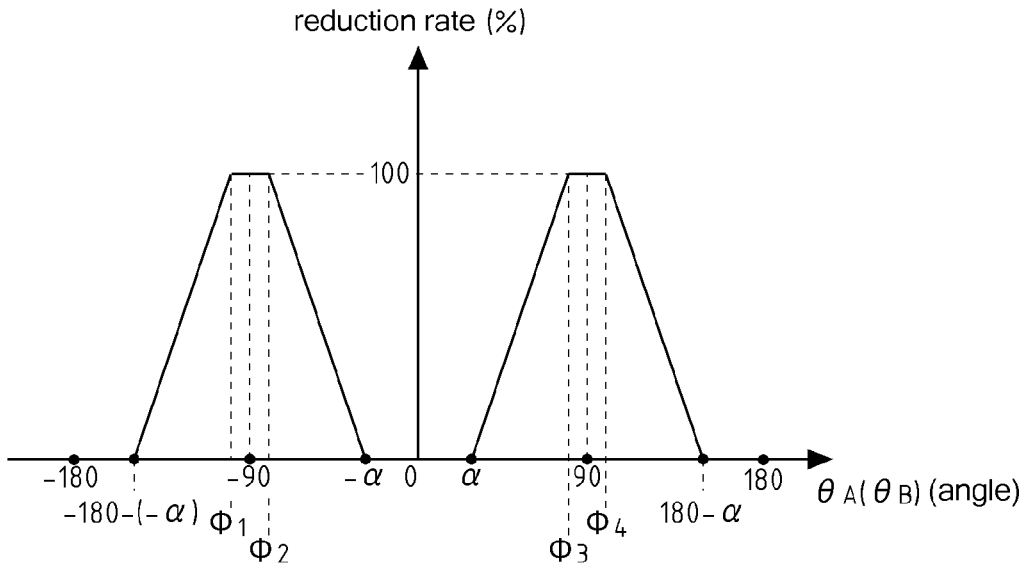
[FIG. 16]

As shown in FIGS. 15 and 16, in the limiting angle mode, by increasing a rotation reduction rate of the engine 7, the engine rotation speed $N_A$ is reduced.

An area shown with slashes in FIG. 15 is a rotation speed reduction area in which the engine rotation speed $N_A$ is reduced gradually, and a colored area is a reduction rate 100% area in which the reduction rate of the engine rotation speed $N_A$ is 100%.

Concretely, as shown in FIG. 16, within a range larger than $-180° - (-\alpha)$ and not more than $\Phi 1$, the reduction rate is increased following the increase of the angle $\beta$ of the composition vector $T_A$, and at $\Phi 1$, the reduction rate is 100%, that is, the engine rotation speed $N_A$ is a low idling rotation speed.

When the angle $\beta$ of the composition vector $T_A$ is larger than $\Phi 1$ and not more than $\Phi 2$, the reduction rate is maintained at 100%.

When the angle $\beta$ of the composition vector $T_A$ is larger than $\Phi 2$ and not more than $-\alpha$, the reduction rate is reduced following the increase of the angle $\beta$. At $-\alpha$, the reduction rate is 0%, that is, the engine rotation speed $N_A$ is the engine rotation speed calculated at the step S400.

Herein, $\Phi 1$ and $\Phi 2$ are angles are linearly symmetrical with −90°. For example, when $\Phi 1$ is −100°, $\Phi 2$ is −80°.

When the angle $\beta$ of the composition vector $T_A$ is larger than $\alpha$ and not more than $\Phi 3$, the reduction rate is increased following the increase of the angle $\beta$. At $\Phi 3$, the reduction rate is 100%, that is, the engine rotation speed $N_A$ is the low idling rotation speed.

When the angle $\beta$ of the composition vector $T_A$ is larger than $\Phi 3$ and not more than $\Phi 4$, the reduction rate is maintained at 100%.

When the angle $\beta$ of the composition vector $T_A$ is larger than $\Phi 4$ and not more than $180° - \alpha$, the reduction rate is reduced following the increase of the angle $\beta$. At $180° - \alpha$, the reduction rate is 0%, that is, the engine rotation speed $N_A$ is the engine rotation speed calculated at the step S400.

Herein, $\Phi 3$ and $\Phi 4$ are angles are linearly symmetrical with 90°. For example, when $\Phi 3$ is 80°, $\Phi 4$ is 100°.

$\Phi 1$, $\Phi 2$, $\Phi 3$ and $\Phi 4$ can be changed within the ranges of $-180° - (-\alpha) \leq \Phi 1 < -90°$, $-90° \leq \Phi 2 < -\alpha$, $\alpha \leq \Phi 3 < 90°$, and $90° \leq \Phi 4 < 180° - \alpha$.

As mentioned above, the ship maneuvering device 1 has the pair of left and right engines 7, the rotation speed changing actuators 4A and 4B independently changing engine rotation speeds N of the pair of left and right engines 7, the pair of left and right outdrive devices 2 respectively connected to the pair of left and right engines 7 and rotating the propellers 11 so as to propel the ship 22, the switching clutches 8 disposed between the engines 7 and the propellers 11, the pair of left and right hydraulic steering cylinders 3 respectively independently rotating the pair of left and right outdrive devices 2 laterally, the joystick 20 setting the traveling direction of the ship, the operation amount detection sensor 39 detecting the operation amount of the joystick 20, and the control device 4 controlling the rotation speed changing actuators 4A and 4B, the switching clutches 8, and the hydraulic steering cylinders 3 so as to travel to a direction set by the joystick 20. From the operation amount of the joystick 20, the control device 4 calculates the oblique sailing component propulsion power vectors $T_{Atrans}$ and $T_{Btrans}$ for the oblique sailing of the left and right outdrive devices 2 and the turning component propulsion power vectors $T_{Arot}$ and $T_{Brot}$ for the turning, and composes the oblique sailing component propulsion power vectors $T_{Atrans}$ and $T_{Btrans}$ and the turning component propulsion power vectors $T_{Arot}$ and $T_{Brot}$ of the left and right outdrive devices 2 so as to calculates the composition vectors $T_A$ and $T_B$, thereby calculating the propulsion powers and the directions of the left and right outdrive devices 2.

According to the construction, in comparison with the case of calculating the propulsion powers and the directions of the left and right outdrive devices 2 based on only the oblique sailing component propulsion power vectors $T_{Atrans}$ and $T_{Btrans}$ and subsequently calculating the propulsion powers and the directions of the left and right outdrive devices 2 based on only the turning component propulsion power vectors $T_{Arot}$ and $T_{Brot}$, by calculating the composition vectors $T_A$ and $T_B$ based on the oblique sailing component propulsion power vectors $T_{Atrans}$ and $T_{Btrans}$ and the turning component propulsion power vectors $T_{Arot}$ and $T_{Brot}$, the final propulsion powers and the final directions can be calculated, whereby smooth operation is obtained without setting priority and operability is improved.

When the angle $\beta$ of the composition vector $T_A$ ($T_B$) is within a range over the predetermined angle range of the outdrive devices 2, the outdrive devices 2 are controlled so as to be made the predetermined limiting angle mode and the engine rotation speed $N_A$ ($N_B$) is reduced to the set rotation speed $N_{set}$.

According to the construction, even if the angle $\beta$ of the composition vector $T_A$ ($T_B$) is over the predetermined angle range of the outdrive device 2 (2), the steering of the outdrive devices 2 (2) can be corrected.

When the angle $\beta$ of the composition vector $T_A$ ($T_B$) is within a range over the predetermined angle range of the outdrive device 2 (2), the rotation angle $\theta_A$ ($\theta_B$) of the outdrive device 2 (2) is fixed at the state of the predetermined limiting angle.

According to the construction, when the angle of the composition vector $T_A$ (TB) is over the predetermined angle range of the outdrive devices 2 (2), frequent change of the rotation angle and frequent switching of forward/reverse rotation of the outdrive device 2 (2) is prevented.

When the angle $\beta$ of the composition vector $T_A$ ($T_B$) is within a range over the predetermined angle range of the outdrive device 2 (2), the engine rotation speed $N_A$ ($N_B$) of the engine 7 (7) is reduced following the reduction of the minor angle between the direction $\beta$ of the composition vector $T_A$ ($T_B$) and the lateral direction of the hull.

According to the construction, when the angle $\beta$ of the composition vector $T_A$ ($T_B$) is over the predetermined angle range of the outdrive devices 2 (2), the switching of forward/reverse rotation of the outdrive devices 2 (2) can be performed smoothly.

Industrial Applicability

The present invention can be used for a ship having an engine, an outdrive device having a propeller rotated by power of the engine, and a clutch engaging and disengaging power transmission from the engine to the propeller.

The invention claimed is:

1. A ship maneuvering device comprising:

an engine;

an outdrive device having a propeller rotated by power of the engine;

a clutch configured to engage and disengage power transmission from the engine to the propeller;

an operation device configured to actuate the outdrive device; and a control device connected to the engine, the clutch, and the operation device, wherein the control device has a first sailing mode at a speed below troll sailing, the control device is connected to a determination device configured to determine whether the first sailing mode is executed or not, and in a case in which execution of the first sailing mode is determined, when an operation amount of the operation device is not more than a baseline operation amount, the control device makes a rotation speed of the engine to be an idling rotation speed and changes a duty ratio, which is a ratio of a time in which the clutch at a predetermined cycle has been turned on corresponding to the operation amount of the operation device, within a range not more than 100%.

2. The ship maneuvering device according to claim 1, wherein when the operation amount of the operation device exceeds the baseline operation amount, the control device makes the duty ratio be 100% and increases the rotation speed of the engine from the idling rotation speed corresponding to the operation amount of the operation device.

3. The ship maneuvering device according to claim 2, wherein when an increased amount of the operation amount of the operation device concerning the baseline operation amount is not higher than a baseline increase amount, the control device maintains the rotation speed of the engine at the idling rotation speed.

4. The ship maneuvering device according to claim 1, wherein the control device is connected to a changing device configured to change the baseline operation amount.

5. The ship maneuvering device according to claim 2, wherein the control device is connected to a changing device configured to change the baseline operation amount.

* * * * *